United States Patent [19]

Rice et al.

[11] 4,001,973

[45] Jan. 11, 1977

[54] REMOVABLE DOOR HINGE SYSTEM

[75] Inventors: Frank L. Rice, Jeffersontown; Arthur C. Wilson, Louisville, both of Ky.

[73] Assignee: General Electric Company, Louisville, Ky.

[22] Filed: Oct. 6, 1975

[21] Appl. No.: 619,669

[52] U.S. Cl. ..... 49/386; 126/191; 126/194

[51] Int. Cl.[2] ..... E05F 1/10

[58] Field of Search ..... 49/386; 126/191, 194; 312/276, 319; 403/14, 326, 330, 361

[56] References Cited

UNITED STATES PATENTS 3,749,080 7/1973 Kleinhenn ..... 126/194

*Primary Examiner*—Peter M. Caun
*Attorney, Agent, or Firm*—Richard L. Caslin; Francis H. Boos

[57] ABSTRACT

An appliance, such as a domestic oven, with a removable oven door hinged to the appliance. The hinge system includes a pair of hinge mechanisms, where each mechanism includes a stationary bracket supporting a pivoted door guide, a spring-loaded hinged lever carried by the door guide, and a separable mating member in the door for cooperation with the door guide. The door guide includes a slip-on self-supporting wire spring that is operable whenever there is a partial removal of the door from the door guide to cause a locking action between the door guide and the support bracket. When the door is reinstalled on the hinge mechanism, the wire spring is unlocked from the support bracket so the door may be closed.

4 Claims, 5 Drawing Figures

REMOVABLE DOOR HINGE SYSTEM

BACKGROUND OF THE INVENTION

1. Field of the Invention:

This invention relates to an appliance such as a domestic oven with a removable hinged door where the door is capable of moving between a vertical closed position and a horizontal open position.

2. Description of the Prior Art:

In a standard electric or gas cooking oven it is advantageous to have a removable oven door for ease in manual cleaning the oven liner walls of food spillage and grease splatter. For the convenience of the user, it should be possible to lift off the door without the use of tools to disassemble anything.

In the past, the door removal action has taken place when the door is positioned in its partially open BROIL position so the counterbalance spring mechanism is in a static condition.

A prior art U.S. Pat. No. 2,873,737 of George R. Sherman is assigned to the assignee of the present invention. This Sherman patent teaches the need for a locking means for locking the pivoted door guide to the stationary support bracket when the door has been removed so that the hinge mechanism will remain in place for receiving the door again when it is to be reinstalled. In the absence of a locking means for the hinge mechanism it might be possible to jar the hinge mechanism loose from its BROIL position and the counterbalance spring would cause the door guide to strike the front of the oven and possibly cause damage to the decorative finish. The locking means of the Sherman patent includes a stop element supported on the distal end of a leaf spring that is riveted in the interior of the door guide.

Another prior art U.S. Pat. No. 3,006,335 of Kermit B. Keeling, Sr. is also assigned to the assignee of the present invention. This Keeling patent has an important advantage for built-in wall ovens where the oven door is located much higher than the oven door of a freestanding range. The hinge axis of the door is about waist high, and it would be awkward to remove the door when it is in its partially open BROIL position. Keeling employs a slidable locking pin for locking the door guide to either the door or alternatively to the stationary support bracket. The door may be removed only when it is in its horizontal fully open position.

Another prior art U.S. Pat. No. 3,842,542 of James A. White and Peter Nowosielski is also assigned to the assignee of the present invention. This White et al patent shows a hinge mechanism with a door guide and mating member in the door that is similar to that of the present invention, but it lacks the locking means of the present invention between the door guide and the stationary support bracket.

The principal object of the present invention is to provide the hinge mechanism of a removable appliance door with an easily assembled automatic locking means of the least number of parts for locking the door guide to the support bracket when the door is removed.

A further object of the present invention is to provide a locking means of the class described in the form of a wire clip that does not require a separate fastener means.

A further object of the present invention is to provide a locking means of the class described with a torsion action that is actuated automatically by the withdrawal of the door from the hinge mechanism.

SUMMARY OF THE INVENTION

The present invention, in accordance with one form thereof, relates to an appliance having an outer cabinet with a front-opening access door. The door has a hinge mechanism joining the door to the cabinet so the door may move between a vertical closed position and a generally horizontal fully open position. The hinge mechanism includes a fixed bracket, a door guide pivoted to the bracket, a hinge lever connected to the door guide, and a counterbalance spring joined between the hinge lever and the rear of the cabinet. The door includes a mating member which cooperates with the door guide. A slip-on self-supporting spring means is carried by the door guide and actuated by the door for engaging and disengaging the spring means from the fixed bracket.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 1:
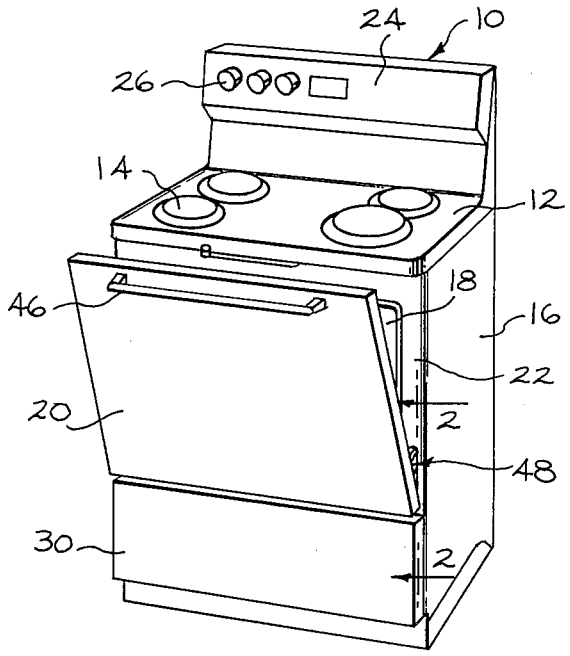
FIG. 1 is a front perspective view of a freestanding range with a removable oven door in which the present invention may be incorporated.

Turning now to a consideration of the drawings and in particular to FIG. 1, there is shown for illustrative purposes, an electric range 10 having a top cooking surface 12 with a plurality of surface heating elements 14. This range has an outer body or cabinet structure 16 which supports the cooktop 12 and a baking and broiling oven 18 located beneath the cooktop. This oven includes a box-like oven liner (not shown) and a front-opening drop-door 20 that together form the oven cooking cavity. The cabinet 16 includes a front frame 22 which surrounds the front opening of the oven liner. A control panel 24 is shown arranged along the back edge of the cooktop 12, and it contains control components 26 for controlling the surface heating units 14 as well as the heating means (not shown) of the oven 18. Located beneath the oven 18 is a storage drawer 30 for storing pans and lids and other cooking utensils.

While an electric range has been shown embodying the removable door hinging system of the present invention, it will readily be apparent to those skilled in this art that the invention could be used on a gas heated oven, or on an automatic dishwasher, or in fact any appliance or cabinet having a drop-down door which is removable.

Figure 2:
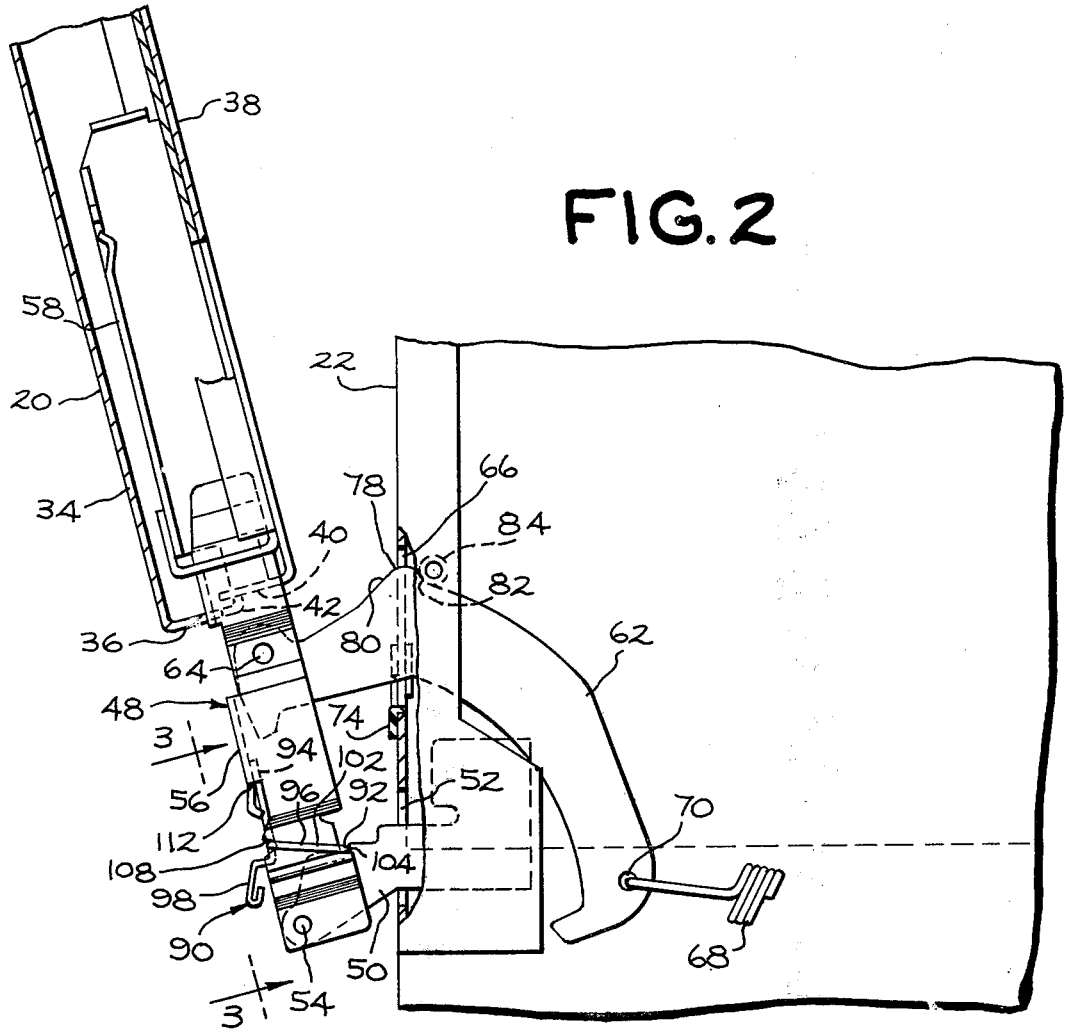
FIG. 2 is a right side, fragmentary, cross-sectional elevational view, taken on the line 2—2 of FIG. 1, on an enlarged scale of the hinge mechanism with the door shown in its partially open BROIL position, and the door partially removed from the door guide, with the spring clip of the present invention being braced against the fixed bracket to prevent the door guide from closing against the oven front frame.

Now turning to the fragmentary cross-sectional elevational view of FIG. 2, the oven door 20 is shown in a partially removed position from its hinge mechanisms 48. The door is generally of hollow sheet metal design having an outer panel 34 of shallow pan configuration with a rearwardly turned peripheral flange 36, and an inner door panel 38 that is also of shallow pan configuration with a frontwardly turned peripheral flange 40 which telescopes slightly into the front panel 34. As a general rule, these two door panels 34 and 38 are held together by having a few horizontally spaced vertically extending tabs 42 formed along the bottom run of the flange 36. These tabs fit into mating slots (not shown) in the lower run of the flange 40 of the inner door panel. This method holds the panels together at the bottom of the door. At the top of the door, the outer door panel 34 is provided with a door handle 46 as is best seen in FIG. 1. Elongated fastening screws (not shown) are threaded from the inner surface of the door through the inner door panel 38 and through the outer door panel 34 and into the end portions of the handle 46 thereby holding the entire door in place. In order to disassemble the door, the handle 46 is disassembled first and then it is possible to lift the inner door panel 38 off of the tabs 42 of the outer door panel 34. This is all fairly common in the oven art, as will be understood by those skilled in this art. The door 20 also would be furnished with thermal insulating material such as fiber glass or the like in order to retard the flow of heat from the oven cooking cavity, but this insulation is not shown since it does not form part of the present invention, and it simplifies the description of the present invention to leave out unrelated structural details.

The oven door 20 has a hinge mechanism 48 at each side of the door adjacent its lower edge comprising a fixed hinge bracket 50 which is attached to the inner side of the front frame 22 of the oven and protrudes forwardly through a slot 52 in the front frame. The outermost end of the hinge bracket 50 includes a hinge pin 54 on which is pivotly supported a door guide 56 in the form of a short post which is adapted to slide into a mating member 58 within the lower portion of the door 20, in the manner of a snug fit so that the door does not wobble with respect to the door guide 56. For better understanding of the nature of this door guide 56 and the mating member 58, attention is directed to the patent of James A. White and Peter Nowosielski, U.S. Pat. No. 3,842,542 entitled "Removable Oven Door Hinge System," which is also assigned to the assignee of the present invention.

Figure 4:
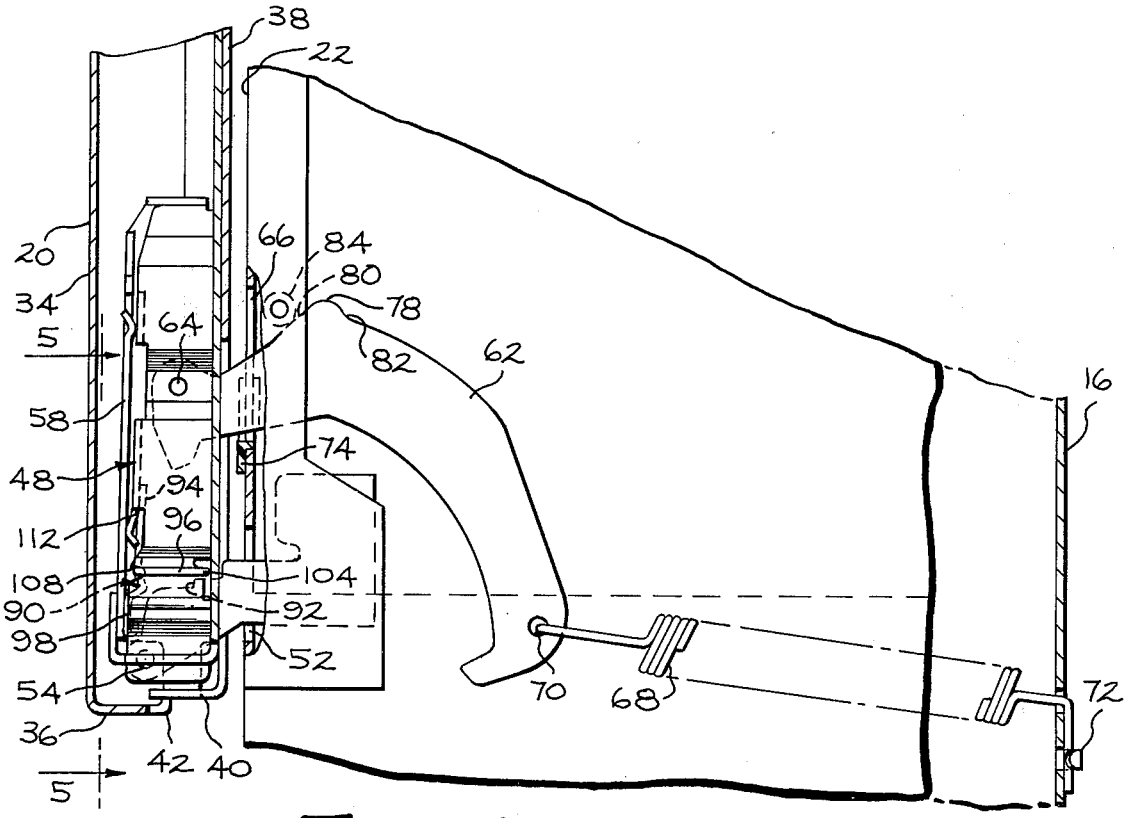
FIG. 4 is right side elevational view, similar to that of FIG. 2, but with the door fully installed on the door guide and showing the spring clip in its unlocked position, and the door in its vertical, fully closed position.

The oven door 20 requires a counterbalance spring mechanism and this is furnished by means of a hinge lever 62 that is pivotally connected to the door guide 56 by a hinge pin 64. A second vertical slot 66 is formed in the front frame 22 of the oven, just above the first slot 52 for receiving the hinge lever 62 therethrough. A strong tension spring 68 is connected at the innermost end 70 of the hinge lever 62, as is best seen in FIG. 4. The opposite end of the spring is fastened at 72 to the oven cabinet structure 16, near the rear of the oven. Since the hinge lever 62 is pivoted to the door guide 56, and the door 20 is assembled on the door guide, the hinge lever is in a sense pivoted to the door through the intermediary of the door guide 56. The hinge lever 62 is of thin metal stock, and generally of arcuate form in side view so that the slot 66 may be kept as short as possible in order to accommodate the movement of the hinge lever through the slot as the door moves between a vertical closed position and a horizontal fully open position. A generally U-shaped nylon bushing 74 is mounted near the lower portion of the slot 66 to serve as a guide and also prevent metal-to-metal contact between the hinge lever 62 and the sides of the slot 66 so as to prevent any rubbing noise from creating a disturbance. Accordingly, the hinge mechanism 48 includes bracket 50, door guide 56, hinge lever 62 and counterbalance spring 68.

The top edge of the hinge lever 62 is provided with a raised cam formation 78 which has a front side 80 and a back side 82. This cam formation 78 cooperates with a roller 84 that has a plastic or other non-metallic face. This cam formation 78 is urged against the roller 84 by the tension spring 68 in certain positions of the door, as seen in both FIGS. 2 and 4. FIG. 2 shows the oven door 20 in a partially open BROIL position of an angle of 15° to 20° and the rear side 82 of the cam formation 78 bears against the side of the roller 84. In order to close the oven door it is necessary to apply a pushing force against the door necessary to overcome the spring force exerted by the spring 68 which would allow the cam formation 78 to slip under the roller 84.

FIG. 4 shows the front side 80 of the cam formation 78 bearing against the roller 84. This exerts a door closing force by virtue of the tension spring 68 pulling on the end of the hinge lever 62. Hence the door assumes a vertical closed position and in order to open the door it is necessary to pull on the door to exert a force to overcome the spring force that holds the inclined cam formation 80 against the side of the roller 84.

The purpose for the partially open BROIL position of the door as shown in FIG. 2, where the door is held open at an angle between about 15° or 20° to the front frame 22, is to allow room ambient air to flow through the oven cooking cavity so that the oven thermostat (not shown) will not cycle OFF and the top BROIL heater element (not shown) will remain energized full time for providing radiant heat for the food to be broiled. This BROIL position of the door is to be compared with a baking position when the oven door 20 is to remain in its vertical closed position.

The oven structure as described above is generally well known in this art. The present invention relates to means for locking the door guide 56 in its partially open BROIL position, as shown in FIG. 2, so that it is not possible to bump against the door guide and cause it to overcome the cam formation 78 of the hinge lever 62 such that the door guide would be capable of slamming against the front frame 22 of the oven which might injure the porcelain enamel finish of the frame and also make it difficult to reinstall the door 20 to the door guide 56.

The present invention comprises a complex wire clip 90 which is carried by the door guide 56 and is operated by the withdrawal of the mating member 58 of the door 20 from the door guide for actuating the wire clip into a locking engagement with the bracket 50, as is shown in the BROIL position of FIG. 2. The top edge of the bracket 50 has a notch 92, and wire clip 90 has a locking portion which is capable of being lowered until it drops into the notch such that the door guide 56 is incapable of moving to a closed position. The wire clip 90 is a slip-on self-supporting spring member in that is is not necessary to provide it with a separate fastening means such as a rivet or the like for holding to the door guide. The wire clip 90 is of thin spring wire stock or gauge comparable to that of a standard paper clip.

Figure 3:
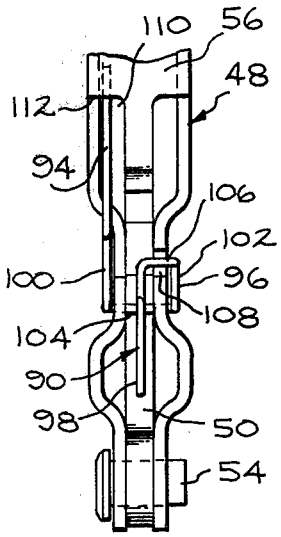
FIG. 3 is a fragmentary view taken on the line 3—3 of FIG. 2 showing a front view of the door guide with the door removed and the locking portion of the spring clip in its lowered locking position.

Looking at FIGS. 2 and 3, the wire clip 90 has an upper vertical fixed end 94, an intermediate locking portion 96 of looped configuration which generally encircles the door guide 56, and a lower vertical trigger portion 98 that is adapted to be acted upon by the mating member 58. The looped locking portion 96 has two parallel sides 100 and 102 which are joined by a bight portion 104 that is adapted to bear against the notch 92 of the bracket 50. Connected to the side 100 is the upper vertical fixed end 94. The other side 102 of the clip includes a partial end or offset seat 106 as best seen in the front views of FIGS. 3 and 5. This partial end 106 is for engagement in a notch 108 in the edge of the door guide. This notch 108 serves as a fulcrum means for the locking portion 96 of the wire clip 90. Extending downwardly from this partial end 106 is the lower vertical trigger portion 98.

Hence, in order to install the wire clip 90 on the door guide 56, the locking portion 96 is slid onto the door guide 56 from the inner edge of the door guide as seen in FIG. 2 moving from right to left until the partial end 106 of the locking portion 96 snaps into the notch 108. Then it is necessary to bend and tuck the upper vertical end 94 of the wire clip under the edge 112 of a slot 110 in the door guide and is thereby held in place. This stressing of the upper vertical end 94 of the spring wire clip under the edge 112 of the door guide exerts a turning or torsion action on the locking portion 96 causing it to assume a natural lowered position as shown in FIGS. 2 and 3. At the same time, the trigger portion 98 assumes an outwardly extending angular position as shown in FIG. 2.

Figure 5:
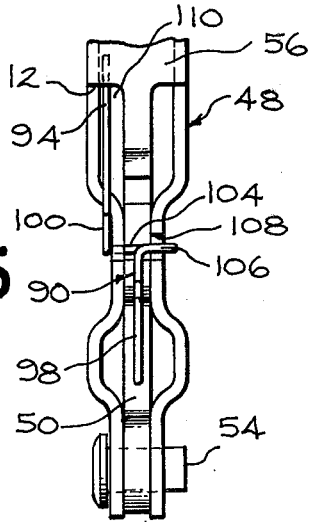
FIG. 5 is a fragmentary front elevational view, taken on the line 5—5 of FIG. 4, and similar to FIG. 3 except the locking portion of the spring clip is in its raised unlocked position.

It should be understood that the door guide 56 is a generally hollow construction of folded sheet metal design that is open in its center as is clear from the front views of FIGS. 3 and 5. The lower portion of the door guide is open at the front, and the trigger portion 98 of the wire clip 90 is free to move in and out of the door guide depending upon the presence of the door on the door guide. When the door 20 is partially removed from the door guide 56, the trigger portion 98 on the wire clip 90 is allowed to spring outwardly to the position shown in FIG. 2. This allows the locking portion 96 of the wire clip to be lowered into its locking BROIL position of FIG. 2. When the oven door 20 is reinstalled on the door guide 56, the mating portion 58 of the door slips down over the door guide 56 causing the trigger portion 98 of the wire clip 90 to be deflected into the interior of the door guide causing the locking portion 96 of the wire clip to pivot about the fulcrum notch 108 so that the locking portion is free of obstruction by the notch 92, and the door 20 is finally capable of being moved to its vertical closed position.

Having described above my invention of a novel self-supporting spring means for use with a hinge mechanism of a removable oven door, it will readily be apparent to those skilled in this art that I have provided a spring means of a complex wire clip which does not require separate fastener means for holding it in place. The wire clip is capable of automatic operation between a locking and an unlocking position depending upon the position of the door on the door guide of the hinge mechanism. This spring means is a simple device to install by means of a slip fit, and it does not require manual manipulation for moving it between a locked and an unlocked position. In fact it is but a single member that has a locking action that is operated automatically by the withdrawal of the door from the door guide.

Modifications of this design will occur to those skilled in this art, therefore, it is to be understood that this invention is not limited to the particular embodiments disclosed but that it is intended to cover all modifications which are within the true scope of this invention as claimed.

What is claimed is:

1. An appliance comprising an outer cabinet with a front-opening access door, the cabinet having a front frame forming a door opening, a pair of hinge mechanisms mounted on the door frame, the door being removably mounted upon the hinge mechanisms and capable of movement between a vertical closed position and a generally horizontal open position, each hinge mechanism comprising a fixed support bracket, a door guide pivotally supported from the support bracket, a hinge lever connected to the door guide, and slot means in the door frame through which the support bracket and hinge lever extend, a mating member mounted in the door for receiving the said door guide, and slot means in the door for reception of the door guide and hinge lever, and counterbalance spring means fixed at one end to the cabinet and attached at the other end to the hinge lever; the invention comprising a slip-on, self-supporting spring means encircling the door guide, said spring means having a fixed portion at one end, an intermediate locking portion of loop configuration, and a trigger portion at its opposite end that normally extends outwardly of the door guide for engagement by the mating member, the support bracket including a keeper for receiving the locking portion of the spring means when the oven door is in a partially open position and the door is partially removed from the hinge mechanisms so as to disengage the mating member from the trigger, while the return of the door to the hinge mechanisms actuates the trigger to disconnect the locking portion from the keeper.

2. An appliance as recited in claim 1 wherein the door guide includes a notch for engaging the locking portion of the spring in the manner of a fulcrum, such that movement of the trigger portion by the mating member of the door causes the locking portion of the spring to pivot about the notch for movement into and out of the said keeper.

3. An appliance as recited in claim 1 wherein the appliance is a baking and broiling oven, and the hinge lever includes cam means for releasably holding the door in the said partially open position which is a broil position, the said slip-on, self-supporting spring means being free of separate attachment fasteners.

4. An appliance as recited in claim 3 wherein the said self-supporting spring means is a wire clip that has a locking portion of an open loop configuration that encircles the door guide with a slip fit, one end of the open loop merging with the fixed portion of the spring clip, while the other end of the open loop has an offset seat for engagement with the notch of the door guide, this offset seat merging with the trigger portion of the spring clip.

* * * * *